US007091817B2

(12) United States Patent
Peck et al.

(10) Patent No.: US 7,091,817 B2
(45) Date of Patent: Aug. 15, 2006

(54) PLANAR TRANSFORMER COMPRISING PLUG-IN SECONDARY WINDINGS

(75) Inventors: Joachim Peck, Bern-Bümpliz (DE); Jürgen Pilniak, Warstein/Allagen (DE)

(73) Assignee: Delta Energy Systems (Switzerland) AG, Bern-Bumpliz (CH)

( * ) Notice: Subject to any disclaimer, the term of this patent is extended or adjusted under 35 U.S.C. 154(b) by 101 days.

(21) Appl. No.: 10/490,435

(22) PCT Filed: Sep. 26, 2002

(86) PCT No.: PCT/CH02/00536

§ 371 (c)(1),
(2), (4) Date: Mar. 24, 2004

(87) PCT Pub. No.: WO03/030189

PCT Pub. Date: Apr. 10, 2003

(65) Prior Publication Data

US 2004/0257190 A1 Dec. 23, 2004

(30) Foreign Application Priority Data

Sep. 28, 2001 (DE) ..... 101 48 133

(51) Int. Cl.
*H01F 27/30* (2006.01)

(52) U.S. Cl. ..... 336/208; 336/200; 336/198; 336/212

(58) Field of Classification Search ..... 336/200, 336/223, 208, 198, 232, 212
See application file for complete search history.

(56) References Cited

U.S. PATENT DOCUMENTS

| | | | | |
|---|---|---|---|---|
| 5,010,314 | A | 4/1991 | Estrov | |
| 5,343,143 | A * | 8/1994 | Voisine et al. | 324/142 |
| 6,727,793 | B1 * | 4/2004 | Piechnick | 336/198 |
| 6,774,755 | B1 * | 8/2004 | Nakata et al. | 336/83 |
| 6,774,757 | B1 * | 8/2004 | Fujiyoshi et al. | 336/200 |
| 6,900,717 | B1 * | 5/2005 | Timashov et al. | 336/208 |

FOREIGN PATENT DOCUMENTS

| | | | |
|---|---|---|---|
| DE | 28 23 779 | A1 | 12/1978 |
| DE | 37 10 783 | A1 | 10/1988 |
| DE | 195 05 463 | A1 | 8/1995 |
| EP | 0 435 461 | A2 | 7/1991 |
| JP | 2000-223320 | A | 8/2000 |
| JP | 2001-267152 | A | 9/2001 |
| WO | WO 91/15681 | A1 | 10/1991 |

* cited by examiner

*Primary Examiner*—Anh Mai
(74) *Attorney, Agent, or Firm*—Birch, Stewart, Kolasch & Birch, LLP

(57) ABSTRACT

The invention aims to prevent the disadvantages of printed circuit board transformers with respect to their quality and safety, in particular in a performance range of greater than 150 VA with output voltages of less than 12 V. This is achieved by a planar transformer comprising a ferrite core (1*a*, 1*b*, 21*a*, 21*b*), at least one primary coil and at least one secondary coil, which can be connected on a printed circuit board and a coil body (3, 23), which encompasses part of the ferrite core (1*a*, 1*b*, 21*a*, 21*b*) and carries at least one secondary coil. According to the invention, each of the secondary coils (3, 23) carried by the coil body is configured from at least one winding metal sheet (2, 22), which is open on one side and can be plugged into the coil body (3, 23) and connected to the printed circuit board.

10 Claims, 4 Drawing Sheets

PLANAR TRANSFORMER COMPRISING PLUG-IN SECONDARY WINDINGS

FIELD OF THE INVENTION

The invention relates to a planar transformer comprising a ferrite core, at least one primary coil and at least one secondary coil, which can be connected on a printed circuit board, and a coil former, which encloses part of the ferrite core and carries at least one secondary coil.

BACKGROUND OF THE INVENTION

As the requirement for the volume-related power density ($VA/in^3$) of a switched-mode power supply increases, the requirements for its inductive components, in particular the main transformer or transformers, also increase. Therefore, for about 20 years, printed circuit card transformers of every conceivable design have increasingly being used, as a separate component or integrated into the main board of a power supply.

One example of such a printed circuit card transformer is known from U.S. Pat. No. 5,010,314. Its primary and secondary coils are etched-in on printed circuit cards, which have a recess in their center, so that the printed circuit cards can be fitted one on top of the other onto the ferrite core of the transformer, with an insulating layer being provided between neighboring printed circuit cards. The printed circuit cards are held together by a coil former comprising two halves, the printed circuit card being disposed with the primary coil between the two halves and the secondary windings being arranged on the mutually averted sides of the halves of the coil former. All the printed circuit cards are embraced by legs which run around on both sides of the halves of the coil former. The ferrite core comprises two E-shaped halves, the coil former carrying the printed circuit cards being fitted onto the middle leg of one of the halves of the ferrite core and the other half of the ferrite core being fitted on from the other side of the coil former.

This type of printed circuit card technology is used primarily for signal transformers, storage inductors and transformers in the power range up to about 150 VA.

In the power range above 150 VA, with outputs with small voltages (<12 V) and correspondingly high output currents, considerable quality problems arise in the manufacture of printed circuit card transformers. For instance, in the case of high currents, the copper thickness of the printed circuit cards must be correspondingly great and then no longer conforms to the standard of the printed circuit card industry.

In the case of high output powers, comparatively expensive printed circuit cards with special thicknesses are required; it may be necessary for standard copper thicknesses to be built up with copper. If printed circuit cards with special copper thicknesses are used, the etching gap between the interconnects can only be guaranteed with optimum process setting. Even the smallest deviations in the process or contaminations cause tiny copper bridges between the interconnects. Such a bridge between two interconnects results in an inadequate number of turns, an interturn short-circuit or, with a conducting connection between the interconnect and the outer edge, even safety-relevant creepage paths between the windings or between the winding and the ferrite core. Such a conducting connection between two interconnects can only be detected during printed circuit card manufacture by elaborate measuring methods directly after the respective process step, or it is only detected in the final functional testing of the completely assembled transformer. However, the value added is lost and much of the material used can no longer be put to further use.

Alternatively, a number of thin layers of copper of multilayered printed circuit cards can be connected in parallel. However, the total thickness of such a printed circuit card is comparatively high because of the insulating layers between the conductor layers. There is also the disadvantage that exact connection of the parallel conductor layers in the printed circuit card is laborious and is only possible with covered vias if required safety standards are to be met.

A further problem, specifically in the case of upright printed circuit card transformers, is the mechanically stable and current-resistant contacting of the printed circuit card with all the required inner layers to the printed circuit board, for example a main board of the power supply.

SUMMARY OF THE INVENTION

The object of the invention is to provide a planar transformer in which the previously mentioned disadvantages do not exist.

This object is achieved by a planar transformer of the type stated at the beginning, in that each of the secondary coils carried by the coil former is formed by at least one metal winding sheet, which is open on one side, can be fitted onto the coil former and can be connected to the printed circuit board.

A basic idea of the invention is to dispense entirely with printed circuit cards and their restriction with regard to the thickness of the conductor layer, and instead to use a metal conductor sheet which is formed as a winding and can be fitted onto the ferrite core. The winding sheet is then connected directly to the printed circuit board, for example to the main board of the power supply unit. As a result, on account of adequate rigidity of the conductor sheet itself, the winding supports itself, while in the case of printed circuit card transformers the windings are all applied to a substrate and are held by the latter, the substrate itself having to be additionally contacted to the main board, for example by angle connectors or edge connectors, and the terminal pins having to be mechanically stabilized.

By using simple winding sheets which are directly interconnected via a printed circuit board as secondary windings instead of printed circuit cards which have one or more windings etched in their conductor layers and are interconnected via terminal strips and connected to the printed circuit board, many advantages over the printed circuit card transformers described at the beginning are unexpectedly obtained.

Firstly, the design and production of such planar transformers is independent of standardized printed circuit cards and their copper thicknesses. Since no printed circuit cards with special copper thicknesses are required any longer, the production costs of the planar transformer can be reduced considerably, to be precise at present up to one quarter of the costs of comparable printed circuit card transformers or even lower. For the same reason, there is no problem any longer with regard to the availability of printed circuit cards of good quality.

The manufacture of such printed circuit card transformers is also simplified to the extent that they can be mass produced virtually anywhere with relatively low expenditure in comparison with printed circuit card transformers and, in particular, there are no single-source dependencies on manufacturers for printed circuit cards with a particular conductor layer thickness.

Secondly, there are no longer any of the disadvantages with regard to possible quality impairments of printed circuit cards in the event of inexact production. Even safety-relevant risks, for example inadequate separation of the primary and secondary coils from one another on account of possible creepage paths and clearances because of air inclusions or contaminations, as exist in the case of printed circuit cards, can be reliably ruled out.

A further considerable advantage is that the terminals of the winding sheet or sheets, inserted and/or soldered to the printed circuit board of a device, serve as mechanical fixing, so that additional adhesive bonding, clamping or screwing of the planar transformer on the device or on the printed circuit board is not required.

Furthermore, the planar transformer according to the invention has considerable advantages over printed circuit card transformers with regard to its environmental performance. For instance, unlike in the case of the manufacture of winding sheets, in the process for manufacturing printed circuit cards considerable amounts of waste are generated and a large amount of energy is required. Added to this is the fact that, in the manufacture of printed circuit boards of a special thickness, the failure rate caused by quality deficiencies is high, while the sheet-metal conductor elements are extremely simple to manufacture, in that for example they are punched out from a flat sheet of conductor material, so that the failure rate in the manufacture of winding sheets is comparatively low. Furthermore, the planar transformer according to the invention can be recycled better, since it is easy to dismantle and fewer composite materials are used, which is particularly important with regard to forthcoming electronic scrap regulations, in which it is expected that manufacturers will be obliged to accept the return of devices supplied.

As a result, the planar transformer according to the invention provides a solution that is technically comparable to that of printed circuit card transformers but considerably less expensive and can be used in particular in the power range of about 150–400 VA.

In one particular refinement of the planar transformer according to the invention, at least two winding sheets are connected together via the printed circuit board to form a secondary coil. It is possible to provide the planar transformer according to the invention with a multiplicity of individual winding sheets, which are optionally connected together via the printed circuit board to form a high-current winding or to form a number of high-current windings with the same number of windings or a different number of windings than one another via the printed circuit board. If the interconnection of the individual winding sheets is controlled by means of a driver or one or more relays, so that individual winding sheets of the or one of the secondary coils can be optionally connected or disconnected, it even becomes possible for a planar transformer provided with a number of winding sheets to be used in a flexible manner. It is also possible on the basis of the principle of the planar transformer according to the invention to create in a short time in comparison with comparable printed circuit card transformers specimens, prototypes and small series with a modified or adapted number of turns, in other words the development times can be reduced.

If a planar transformer according to the invention is configured with two winding sheets, they can be arranged on both sides of the primary coil, with adequate insulation having to be provided between the secondary windings and the primary coil. If a number of winding sheets are arranged next to one another, they may either be respectively coated with an insulating layer, or it is preferred to arrange an insulating intermediate layer between two neighboring winding sheets. The latter configuration is of advantage to the extent that the respective winding sheet consists exclusively of a conductor material and can be reused more easily.

Punched or eroded copper sheets are used with preference as the winding sheets. Copper is in this case a preferred conductor material, which can be easily processed. The winding sheets are also preferably electro-tin-plated—in particular in the region of their terminal ends—, so that the metal sheets can be soldered more easily and can also be stored better.

Furthermore, the coil former of the planar transformer according to the invention has a guide for at least one of the winding sheets, into which the winding sheet is pushed. As a result, the winding sheet is fixed in its position with respect to the ferrite core, so that no losses in quality or safety are caused by misaligned inserted winding sheets. For the same purpose, at least one of the winding sheets and/or at least one of the insulating intermediate layers may have a recess, which interacts with a detent of the coil former. Another possibility for fixing winding sheets is for example that the printed circuit board has slot-shaped receptacles, into which the winding sheets can be inserted and consequently at the same time fixed.

In a further preferred refinement of the planar transformer, the coil former has a winding chamber for the primary coil, it being possible for the primary coil to comprise one or more wound conductor wires. It is in fact possible in principle, in a way similar to in the case of printed circuit card transformers, to arrange the primary winding on a printed circuit card and arrange it between two halves of a coil former. If, however, it is wished to dispense entirely with printed circuit cards, this preferred refinement is suitable, it then being possible for the coil former to be formed in one piece, for example as an injection molding of a suitable, insulating plastic. In this case, the coil former has a casing, which encases part of the ferrite core, and two peripheral walls, protruding perpendicularly outward from the center axis of the casing. The conductor wire can then be wound up onto the casing between the walls, while the winding sheets for the secondary winding are fitted on on the side of the walls averted from the winding chamber. The width and height of the winding chamber formed by the casing and the walls can in this way be adjusted such that, with a given wire diameter, a uniform build-up of the winding with a constant number of turns per layer and—in the case of mass-produced transformers—a consistent number of layers is achieved and the winding chamber is optimally filled.

One particular advantage of this configuration is that a reliable primary-secondary separation is always ensured, since, assuming correct assembly, the construction of the coil former means that the distance between the primary and secondary coil(s) can never be less than the distance required. The creepage paths and clearances between the primary winding and secondary winding required for various approvals (usually >6.4 mm) are far exceeded, depending on the particular form of the injection-molded body (thickness of the walls) . A further considerable advantage is that, when a wound conductor wire is used as the primary winding, it is possible to dispense entirely with printed circuit cards within the planar transformer, so that higher operating temperatures are possible, depending on the material used for the coil former. By contrast, in the case of printed circuit card transformers, the maximum operating temperature is limited to about 130° C. by the Tg value (glass transition temperature) of the carrier material and corresponding approval of printed circuit card transformers.

In a further refinement of this configuration of the coil former, for each primary coil at least two receptacles for terminal pins are provided, to which the beginning and the end of at least one conductor wire of a primary coil winding are connected. The advantage is easy manufacture, it being possible for the ends of the primary coils first to be soldered onto the terminal pins, before the planar transformer with the intrinsically rigid terminal pins is simply placed onto the printed circuit board and the terminal pins are soldered onto the printed circuit board.

The coil former may additionally be advantageously formed with at least one wire-guiding groove, running from the bottom of the winding chamber to one of the terminal pins, obliquely with respect to the axis of this terminal pin. This achieves the effect on the one hand that the windings of a layer can rest in such a way that they are completely planar and parallel to one another on the bottom of the winding chamber, without these windings having to be led around the end piece of the conductor wire, or one of the windings rests on this end. Consequently, pressure relief of the windings of all the layers of windings is achieved, since each winding rests exactly on the winding of the layer lying under it. On the other hand, with the wire-guiding groove, tension relief of the end piece of the conductor wire is reliably ensured at the terminal pin during the winding on of the primary coil.

As already mentioned above, the coil former is preferably formed in one part, in particular as an injection molding.

The planar transformer according to the invention is preferably formed with a ferrite core, which is put together from two E-shaped core halves, the coil former being disposed on the middle of the three core legs that are parallel to one another. It may be formed in particular with an ETD, EFD, ELP or PQ core. It is also possible to form the planar transformer with a ferrite core that is closed one one side (U core) instead of with such a ferrite core that is closed on two sides; in the case of the U core, the primary coil(s) is (are) disposed on one leg and the insertable winding sheets of the secondary coil(s) is (are) disposed on the other leg. However, other configurations, in which the planar transformer is formed with a toroidal core, are also conceivable in principle. In this case, it would be suitable for example to form the coil former in two parts in such a way that each part comprises a casing half, the casing halves being put together to form a casing around the toroidal core.

The invention is explained in more detail below on the basis of figures, which show preferred configurations of the planar transformer according to the invention.

DETAILED DESCRIPTION

Figure 1:
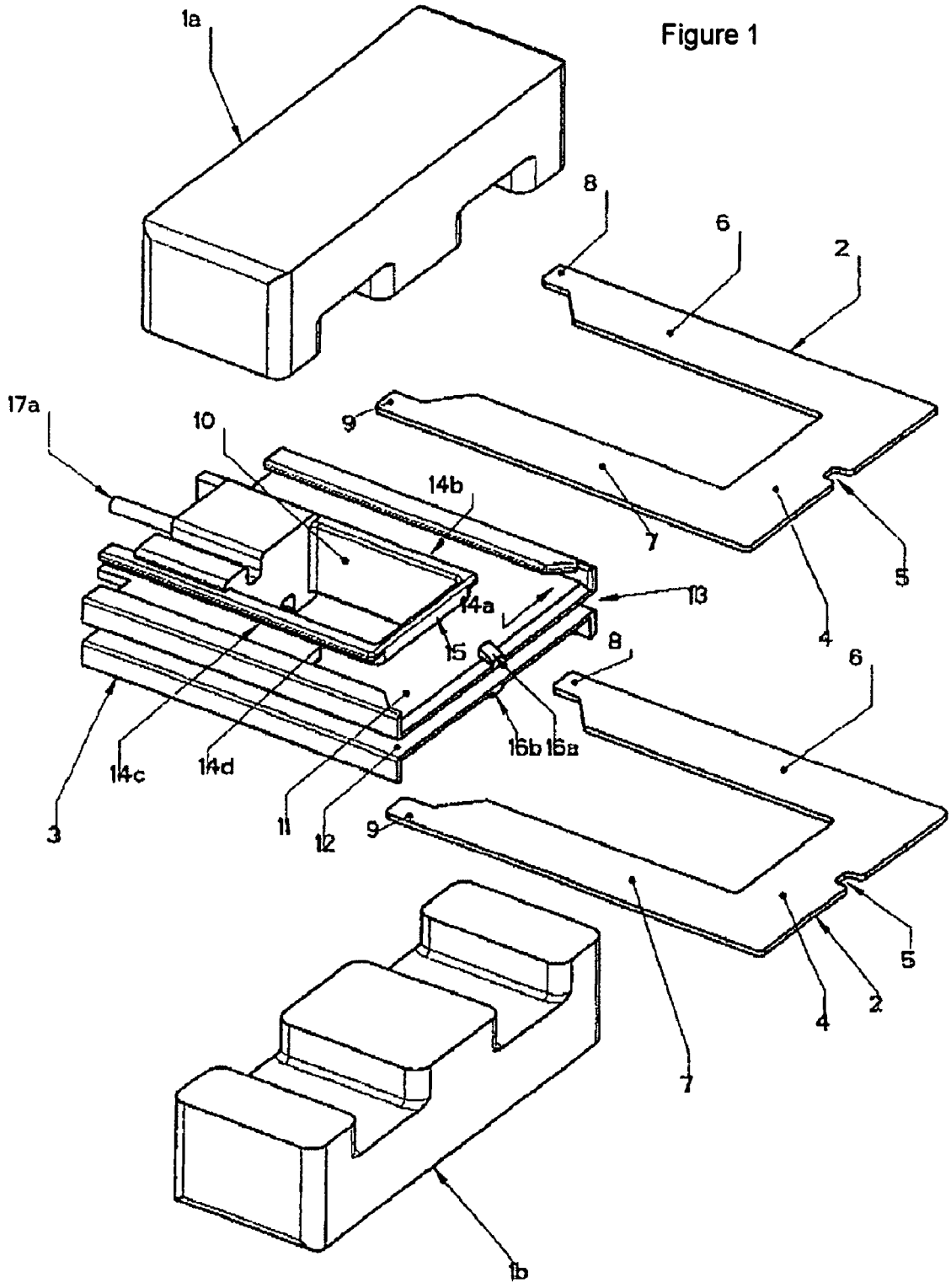
FIG. 1 shows an exploded drawing of a first preferred embodiment of the planar transformer.

FIG. 1 shows essential components of an exemplary embodiment of the planar transformer according to the invention, to be specific a three-leg ferrite core comprising two halves 1*a*, 1*b*, two winding sheets 2 forming a secondary coil, and a coil former 3. The primary winding is not shown for the sake of a clearer overview.

The winding sheets 2 consist of a conductor material and are preferably punched out or eroded from a copper sheet and are tin-plated. They have an essentially U-shaped profile, that is to say they are open to one side. The upper cross-piece 4 of the U-shaped profile has at the center of the outer edge a small, essentially rectangular notch 5. Both ends of the cross-piece are adjoined by free legs 6, 7.

The thickness of the winding sheets 2 is small in comparison with the width of their cross-pieces 4 and of the legs 6, 7. The width of a predominant part of the legs 6, 7 corresponds essentially to the width of the cross-piece 4 in the region of the notch 5. The free ends of the legs 6, 7 are formed as solder or plug-in contacts 8, 9, the width of which is somewhat less than half that of the predominant part of the legs 6, 7. The ends could also be formed as insulation-piercing contacts, in that they are beveled.

The coil former 3 is a one-piece injection molding with a casing surface 10, which in the assembled state of the planar transformer encloses the middle leg of the ferrite core. The casing surface 10 is adjoined by two walls 11, 12, which run perpendicularly in relation to it and in the peripheral direction and together with the casing surface 10 form a winding chamber 13 for the primary coil that is open outward in the peripheral direction. The width and height of this winding chamber are adjusted to match one another in such a way that, with a chosen wire diameter of the conductor wire for the primary coil, a uniform build-up of the winding with a constant number of conductors per layer can be achieved and the winding chamber optimally filled. This allows the build-up of the winding of the primary coil to be optimized in electrical and magnetic aspects, in particular with regard to skin and proximity effects.

Two lateral guiding slots 14*a*, 14*b*, 14*c*, 14*d* are respectively provided on each of the walls 11, 12, on their side averted from the winding chamber 13, for each free leg 6, 7 of the winding sheets 2, the guiding slots 14*a*, 14*d* that are arranged on the outer edge of the walls 11, 12, for the outer edges of the legs 6, 7 of the winding sheets, extending over the entire edge length of the walls 11, 12 and the guiding slots 14*b*, 14*c* for the inner edges of the free legs 6, 7 extending from the upper casing surface 10 to the lower edge of the coil former 3. In addition, an abutting edge 15 for the inner side of the cross-pieces 4 of the winding sheets 2 is formed on the upper casing surface 10, on both outer sides of the walls 11, 12, and a detent 16*a*, 16*b* is formed centrally on the upper edges of the walls 11, 12, so that the winding sheets 2 pushed into the coil former 3 on the outer sides of the walls 11, 12 are completely fixed by the guiding slots 14*a*, 14*b*, 14*c*, 14*d*, the abutting edges 15 and the detents 16*a*, 16*b* interacting with the notches 5, with the solder or plug-in contacts 8, 9 of the winding sheets 2 protruding beyond the lower edge of the coil former 3. With this fixing it is ensured that a defined distance from the later inserted-through ferrite core 1*a*, 1*b* always exists, which is absolutely necessary for compliance with existing safety and approval requirements. At the same time, an adequate proportion of the surface area of the winding sheets 2 is impinged directly by the forced air stream of the device, so that adequate cooling of the transformer can be ensured.

Figure 2:
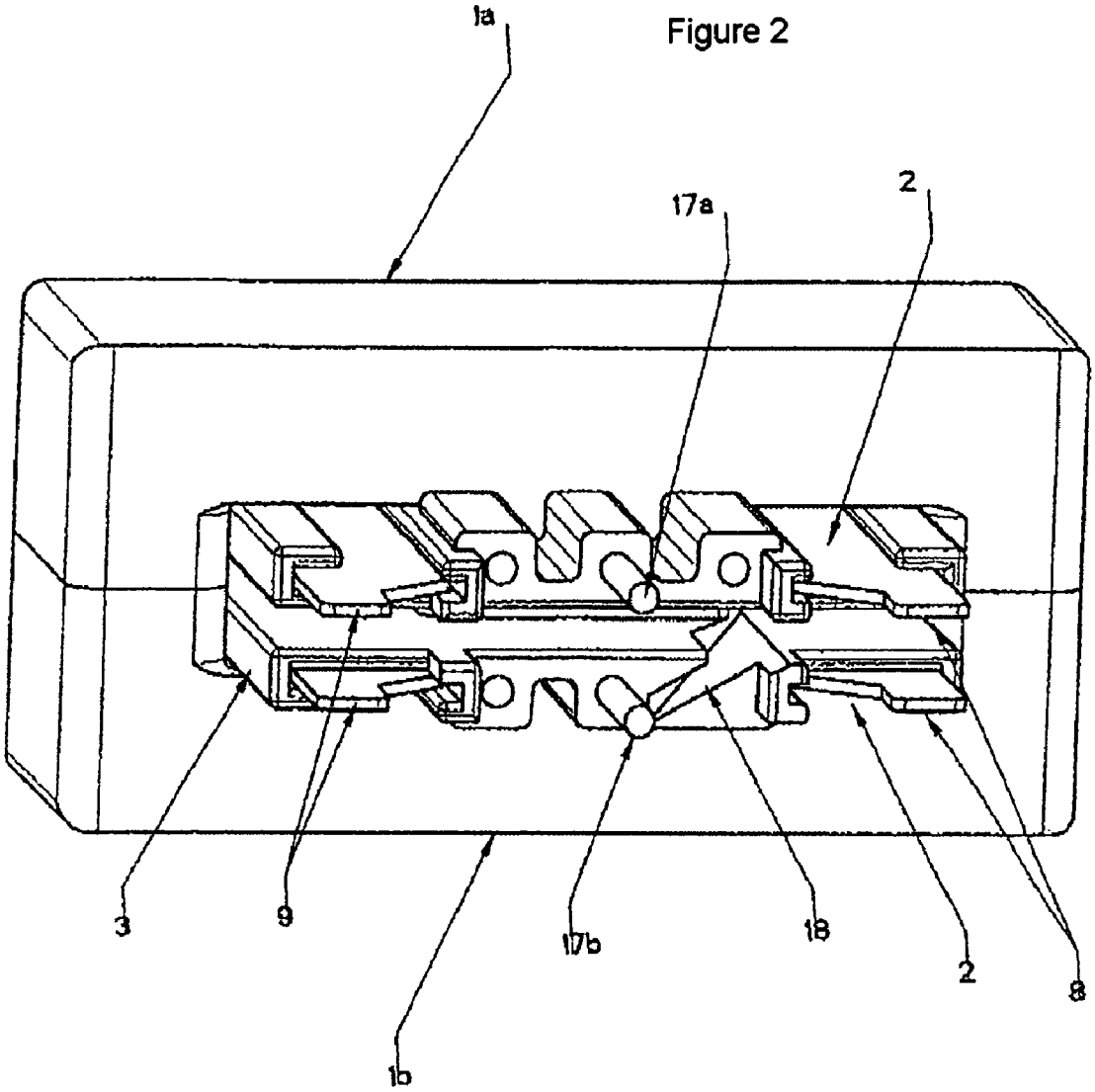
FIG. 2 shows an isometric view from below of the planar transformer represented in FIG. 1, with inserted winding sheets.

As also revealed in particular by FIG. 2, in which the planar transformer with inserted winding sheets 7 is represented in a view from below, the walls 11, 12 are formed in a thickened manner in their lower region between the guiding slots 14*a*, 14*b*, 14*c*, 14*d* for the inner leg edges, and respectively have at least one downwardly open bore as a receptacle for terminal pins 17*a*, 17*b*, which have a square cross section, for the connection of the ends of the primary windings. The diameter of the bores is somewhat smaller than the cross-sectional diagonal of the terminal pins 17*a*, 17*b*, so that the terminal pins 17*a*, 17*b* have to be pressed into the bores and are adequately fixed on account of the press fit. The terminal pins 17*a*, 17*b* pressed into the bores protrude by approximately the same distance beyond the lower edge of the coil former 3 as the solder or plug-in contacts 8, 9.

In one of the thickened regions of the walls 11, 12, a wire-guiding groove 18 that is open in the downward direction and runs obliquely with respect to the axis of the terminal pins 17*a*, 17*b* is provided from the terminal pin 17*b* to the winding chamber 13. This wire-guiding groove 18 avoids unnecessary mechanical pressure on the wire of the beginning of the winding being exerted by the turns which follow, which under some circumstances could lead to sparkovers and interturn short-circuits in the winding during operation under high primary voltages that are possibly applied.

For putting together the planar transformer represented, firstly the coil former 3 is provided with the terminal pins 17. After pressing the terminal pins 17 in, the desired number of turns of the primary winding are wound on in a conventional way with a winding machine in the winding chamber 13 of the coil former 3. Depending on the insulation requirement of the device, the conductor wire for the primary winding may be configured for example as a single- or multi-insulated round copper wire or else as a nylon-braided high-frequency litz wire. For winding on, the beginning of the conductor wire for the primary coil is stripped of insulation to the required length and wound around one of the terminal pins 17. From this terminal pin 17, the conductor wire is led through the obliquely running wire-guiding groove to the bottom of the winding chamber 13, wound up in the winding chamber to form the primary coil and the correspondingly stripped end of the conductor wire is then led to the other terminal pin and wound around it. After that, the terminal pins 17 are soldered to the stripped wire ends, for example in a dip-flow-soldering bath.

After the soldering, the winding sheets 2 as secondary windings are pushed into the guiding slots 14*a*, 14*b*, 14*c*, 14*d* on both sides of the winding chamber 13. When they are being pushed in, the winding sheets 2 must engage in the detents 16*a*, 16*b* of the coil former 3, in order to prevent the winding sheets 3 from sliding back later, for instance during transport or during the assembly of the entire transformer on a circuit board. Finally, the two ferrite core halves 1*a*, 1*b* are pushed with their middle legs on both sides into the coil former 3 and adhesively bonded to one another. Alternatively, the ferrite core halves 1*a*, 1*b* may also be held together by clamps or adhesive tape wound around the entire ferrite core.

The planar transformer put together in this way can then be placed onto a printed circuit board (not represented here) and soldered on it. The printed circuit board is formed in such a way that the winding sheets 2 are then connected together as the secondary coil.

Finally, the functional and safety testing of the complete transformer is performed.

Figure 3:
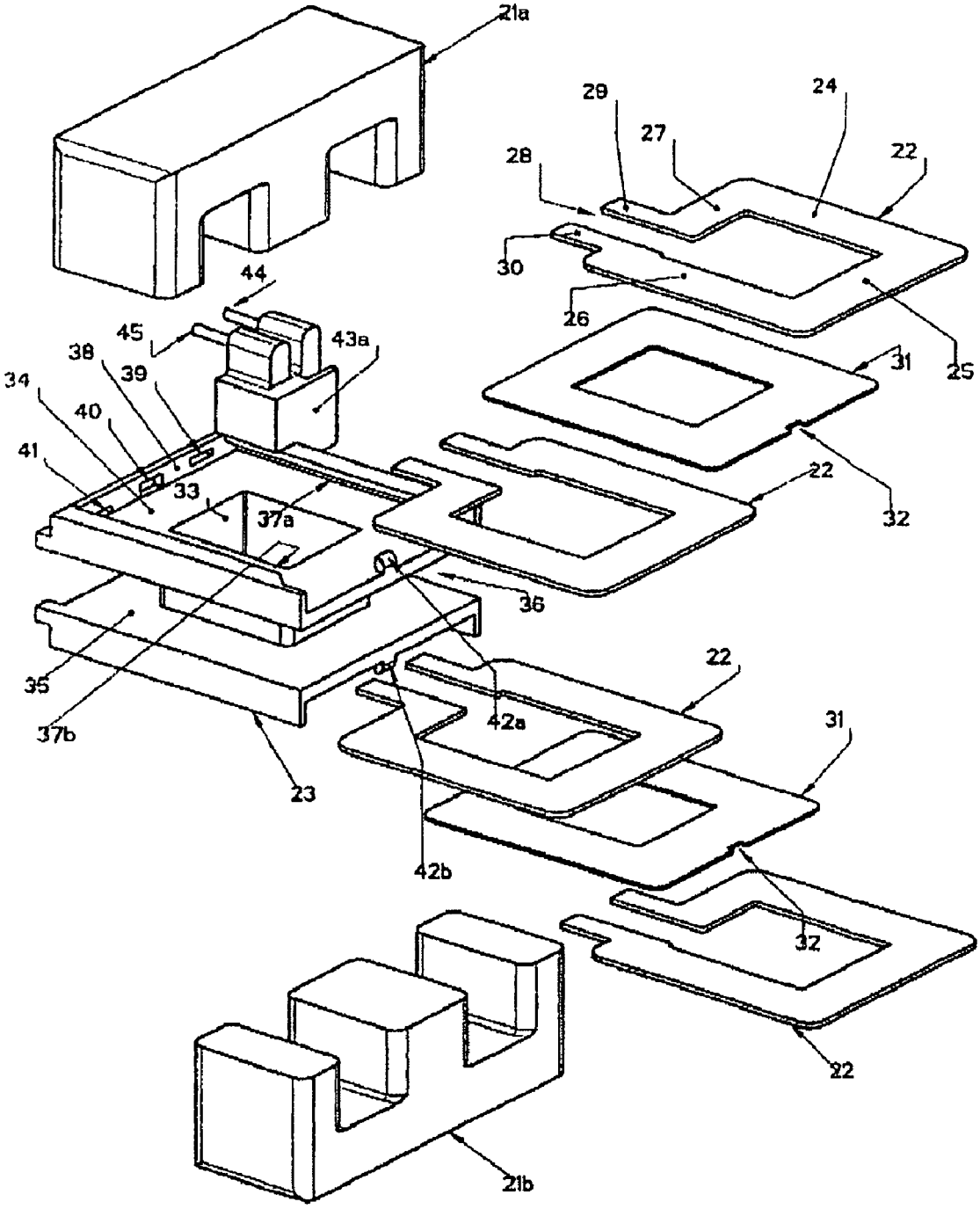
FIG. 3 shows an exploded drawing of a second preferred embodiment of the planar transformer.

In FIG. 3, essential components of another preferred embodiment of the planar transformer according to the invention are represented. It has a three-leg ferrite core, comprising two halves 21*a*, 21*b*, four winding sheets 22, which can be connected together via a printed circuit board (not represented) to form one or more secondary windings, and a coil former 23. The printed circuit board and the primary winding are also not shown here for the sake of a clearer overview.

The winding sheets 22 differ from those of the previously described embodiment in that each winding sheet 22 is formed from four legs 24, 25, 26, 27 of the same width that are perpendicular to one another, the lower leg 27 not being continuous but interrupted on one side. On both sides of the interruption 28 in the lower leg 27, solder or plug-in contacts 29, 30 adjoin the lower leg 27 in the downward direction, one of the solder or plug-in contacts 29 being arranged in the middle of the lower edge of the winding sheet 22.

Additionally provided are two insulating layers 31, the profiles of which are formed by four peripheral legs, which are somewhat wider than the legs of the winding sheets 22, so that two winding sheets 22 between which such an insulating layer 31 is arranged are electrically completely insulated from one another. At their upper edge, the insulating layers respectively have a notch 32.

Also in the case of this embodiment, the coil former 23 is a one-piece injection molding with a casing surface 33, which in the assembled state of the planar transformer encloses the middle leg of the ferrite core. The casing surface 33 is adjoined by two walls 34, 35, which run perpendicularly in relation to it and in the peripheral direction and together with the casing surface form a winding chamber 36 that is open outward in the peripheral direction. The width and height of this winding chamber 36 are adjusted to match one another in such a way that, with a chosen wire diameter, a uniform build-up of the winding with a constant number of conductors per layer is achieved and the winding chamber 36 can be optimally filled.

A guiding frame for the winding sheets 22 is provided on each of the walls 34, 35, on their side averted from the winding chamber 36, and has guiding slots 37*a*, 37*b* for the outer edges of the lateral legs 24, 26 of the winding sheets 22, which extend over the entire edge length of the walls 34, 35, and a lower leg 38, which forms an abutting edge for the lower edge of the winding sheets 22 pushed into the guiding slots 37*a*, 37*b*. The guiding slots 37*a*, 37*b* are dimensioned such that two winding sheets 22 between which an insulating layers 31 is arranged can be pushed in. The lower leg 38 of the guiding frame has interruptions 39, 40, 41 for inserting through the solder or plug-in contacts 29, 30 of the winding sheets 22, with a central interruption 40 being provided, through which the two central solder or plug-in contacts 29 of the two winding sheets lying next to one another can be inserted, and two further interruptions 39, 41 for the other plug-in contact 30 respectively of the winding sheets 22 being provided on both sides of the central interruption.

As in the case of the previously described exemplary embodiment, a detent 42*a*, 42*b* is formed centrally on the upper edges of the walls 34, 35. If two winding sheets 22 are stacked one on top of the other together with an insulating layer 31 lying in between, in such a way that the central solder or plug-in contacts 29 lie next to one another and the lateral solder or plug-in contacts 30 lie on different sides respectively of the central solder or plug-in contacts 29, they can be pushed into the guiding frame, so that they are completely fixed in their position on the coil former 23 by the guiding frame and the detent 42*a*, 42*b*.

Figure 4:
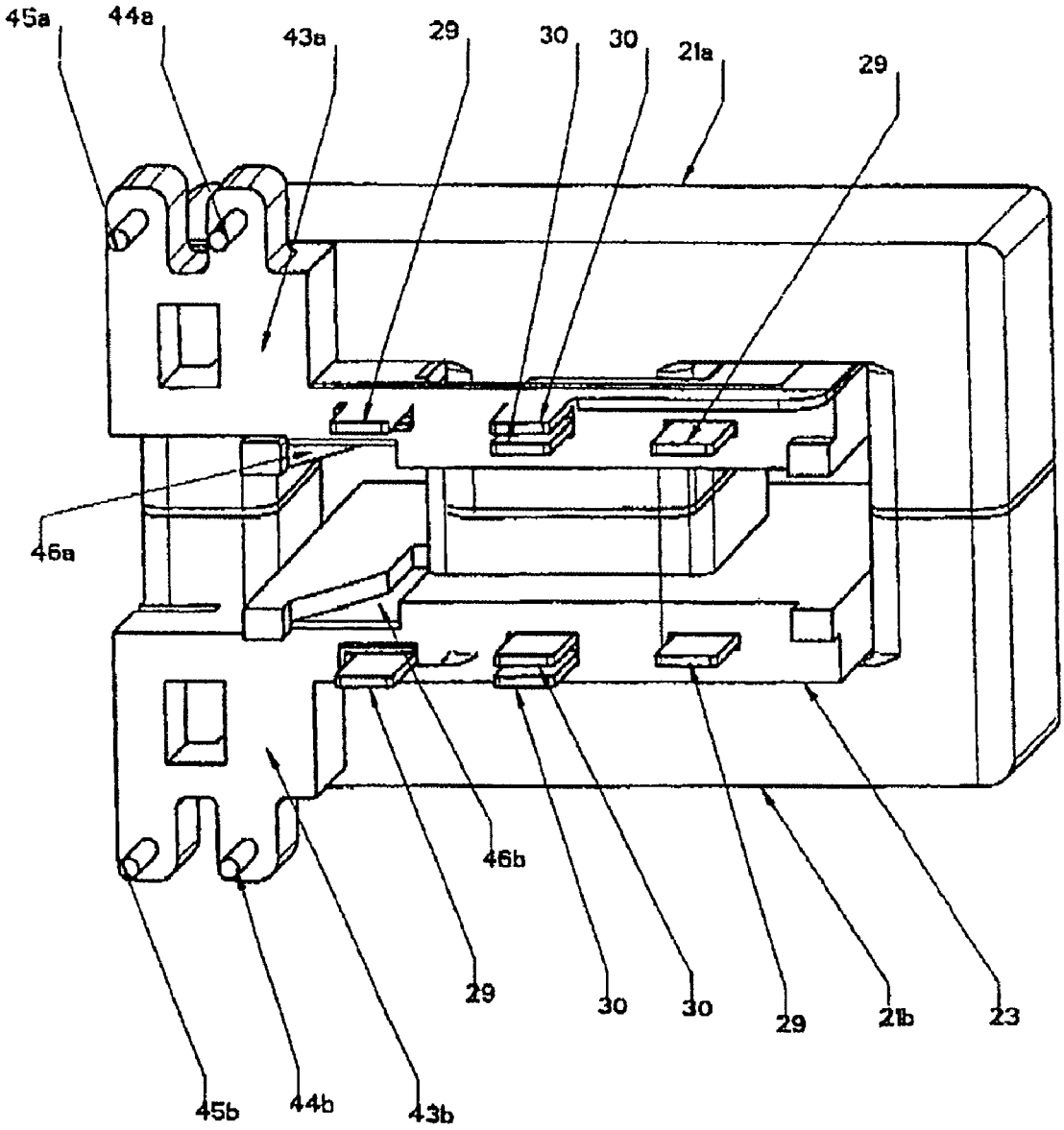
FIG. 4 shows an isometric view from below of the planar transformer represented in FIG. 3, with inserted winding sheets.

As FIG. 4 reveals in particular, on the outer edge in each case of one of the guiding slots 37*a* of the guiding frames there respectively extend in the direction away from the winding chamber receiving blocks 43*a*, 43*b* with bores for receiving in each case two terminal pins 44*a*, 45*a*, 44*b*, 45*b* for two separate primary coil windings. The underside of these blocks 43 terminates with the lower edge of the coil former 23. The terminal pins 44*a*, 45*a*, 44*b*, 45*b* inserted into the bores protrude by approximately the same distance beyond the lower edge of the coil former 23 as the solder or plug-in contacts 29, 30 inserted through the interruptions 39, 40, 41 of the guiding frame.

It is evident from the view from below of the planar transformer with inserted windings represented in FIG. 4 that here, too, wire-guiding grooves 46*a*, 46*b* run from the winding chamber 36 in the direction of the underside of the wall. The end or ends of the conductor wire or conductor wires of one or more primary coils may be led by these grooves away from the bottom of the winding chamber 36 via the undersides of the receiving blocks 43*a*, 43*b* to one of the terminal pins 44*a*, 45*a*, 44*b*, 45*b* or to both terminal pins 44*a*, 45*a*, 44*b*, 45*b* of a receiving block 43*a*, 43*b*.

On the underside of the coil former, four positioning feet 47*a*, 47*b*, 47*c*, 47*d* protrude and can be used for positioning the ready assembled planar transformer on a printed circuit board if corresponding recesses have been provided in the latter.

This embodiment of the planar transformer according to the invention is put together in just the same way as the embodiment described above, with the exception of the different type of insertion of the winding sheets 22 together with the insulating layer 31 into the guiding frames and the possibility of winding on two primary windings in the winding chamber 22 and connecting them to the terminal pins 44, 45.

It applies to both embodiments that the terminals of the sheets must be correspondingly interconnected on the main board of the device by interconnects, in order to obtain the number of turns desired for the respective topology of the circuit, for example a number of turns of 1 or 2 is possible on the secondary side in the case of a two-sheet variant or 2 or 4 in the case of a four-sheet variant of this invention.

The wide and thick interconnects to the winding sheets that are required due to the high secondary currents likewise provide for dissipation of heat from the transformer. Moreover, the 4 or 8 solder points (beginning and end of each winding sheet) provide an extremely stable connection between the transformer and the main printed circuit card of the device. Further fastenings are not required.

The invention claimed is:

1. A planar transformer comprising a ferrite core, at least one primary coil and at least one secondary coil, which can be connected on a printed circuit board, and a coil former with a casing surface, the coil former enclosing part of the ferrite core and carrying at least one secondary coil, wherein each of the secondary coils carried by the coil former is formed by at least one metal winding sheet, which is open on one side, and the primary coil comprising at least one wound conductor wire, the coil former having two walls, which perpendicularly adjoin the casing surface, run in the peripheral direction and together with the casing surface form a winding chamber for the primary coil that is open outward, and in that at least one of the walls has on a side averted from the winding chamber in each case two guiding slots, it being possible for at least one of the winding sheets to be inserted into the guiding slots and to be connected to the printed circuit board.

2. The planar transformer as claimed in claim 1, wherein at least two winding sheets are connected together via the printed circuit board to form a secondary coil.

3. The planar transformer as claimed in claim 2, wherein an insulating intermediate layer is arranged between two winding sheets arranged next to one another on the coil former.

4. The planar transformer as claimed in one of claims 1 to 3, wherein the winding sheets are punched or eroded copper sheets.

5. The planar transformer as claimed in claim 4, wherein the winding sheets are electro-tin-plated.

6. The planar transformer as claimed in claim 5, wherein at least one of the winding sheets and/or at least one of the insulating intermediate layers has a notch, which interacts with a detent of the coil former.

7. The planar transformer as claimed in claim 6, wherein the coil former has at least two receptacles for terminal pins, to which the beginning and the end of at least one conductor wire are connected.

8. The planar transformer as claimed in claim 7, wherein at least one wire-guiding groove, running from the bottom of the winding chamber to at least one of the terminal pins and obliquely with respect to the axis of this terminal pin.

9. The planar transformer as claimed in claim 1, wherein the coil former is in one part.

10. The planar transformer as claimed in claim 1, wherein the ferrite core is put together from two E-shaped core halves and the coil former is disposed on the middle of the three core legs that are parallel to one another.

* * * * *